US007912225B2

(12) United States Patent
Chen

(10) Patent No.: US 7,912,225 B2
(45) Date of Patent: Mar. 22, 2011

(54) GENERATING 3D AUDIO USING A REGULARIZED HRTF/HRIR FILTER

(75) Inventor: Jiashu Chen, Homdel, NJ (US)

(73) Assignee: Agere Systems Inc., Allentown, PA (US)

( * ) Notice: Subject to any disclaimer, the term of this patent is extended or adjusted under 35 U.S.C. 154(b) by 1323 days.

(21) Appl. No.: 11/448,327

(22) Filed: Jun. 7, 2006

(65) Prior Publication Data

US 2006/0251276 A1 Nov. 9, 2006

Related U.S. Application Data

(63) Continuation of application No. 09/190,207, filed on Nov. 13, 1998, now Pat. No. 7,085,393.

(60) Provisional application No. 60/065,855, filed on Nov. 14, 1997.

(51) Int. Cl.
*H04S 5/00* (2006.01)

(52) U.S. Cl. ..... 381/17; 367/135

(58) Field of Classification Search ..... 381/26, 381/310, 23, 77, 79, 91, 92, 122, 123, 124, 381/80, 81, 61, 17, 18; 369/1–12; 700/94; 710/303; 341/155; 463/35
See application file for complete search history.

(56) References Cited

U.S. PATENT DOCUMENTS

| | | | | |
|---|---|---|---|---|
| 5,500,900 | A * | 3/1996 | Chen et al. | 381/17 |
| 5,659,619 | A | 8/1997 | Abel | 381/17 |
| 7,085,393 | B1 * | 8/2006 | Chen | 381/310 |
| 7,231,054 | B1 * | 6/2007 | Jot et al. | 381/310 |

FOREIGN PATENT DOCUMENTS

| | | |
|---|---|---|
| EP | 0448890 A1 | 10/1991 |
| JP | 62-145297 | 6/1987 |
| JP | 1240032 | 9/1989 |

OTHER PUBLICATIONS

V. Ralph Algazi, et al., "Elevation localization and head-related transfer function analysis at low frequencies", J. Acoust. Soc. Am., 109(3), Mar. 2001, p. 1110-1122.*

Corey I. Cheng, "Visualization, Measurement, and Interpolation of head-related transfer functions (HRTF's) with Applications in Electro-Acoustic Music", dissertation, The University of Michigan, Aug. 2001, pp. 1-205.*

Jiashu Chen, et al., "*A Spatial Feature Extraction and Regularization Model for the Head-Related Transfer Function*," Journal of Acoustical Society of America, Jan. 1995, pp. 439-452.

(Continued)

*Primary Examiner* — Vivian Chin
*Assistant Examiner* — Leshui Zhang
(74) *Attorney, Agent, or Firm* — Mendelsohn, Drucker & Associates, P.C.; Steve Mendelsohn

(57) ABSTRACT

3D sound is generated using an improved HRTF modeling technique for synthesizing HRTFs with varying degrees of smoothness and generalization. A plurality N of spatial characteristic function sets are regularized or smoothed before combination with corresponding Eigen filter functions, and summed to provide an HRTF (or HRIR) filter having improved smoothness in a continuous auditory space. A trade-off is allowed between accuracy in localization and smoothness by controlling the smoothness level of the regularizing models with a lambda factor. Improved smoothness in the HRTF filter allows the perception by the listener of a smoothly moving sound rendering free of annoying discontinuities creating clicks in the 3D sound.

20 Claims, 3 Drawing Sheets

OTHER PUBLICATIONS

Jiashu Chen, et al., "*External Ear Transfer Function Modeling: A Beamforming Approach*," Journal of Acoustical Society of America, Oct. 1992, pp. 1933-1944.

Richard A. Reale, et al., "*Am Implementation of Virtual Acoustic Space for Neurophysiological Studies of Directional Hearing*," Virtual Auditory Space: Generation and Applications, Chapter 5, 1996, pp. 153-183.

Tomaso Poggio et al., "*From Regularization to Radial, Tensor and Additive Splines*," Neural Networks for Signal Processing, 1993, pp. 223-227.

* cited by examiner

GENERATING 3D AUDIO USING A REGULARIZED HRTF/HRIR FILTER

CROSS-REFERENCE TO RELATED APPLICATIONS

This is a continuation of application Ser. No. 09/190,207, filed on Nov. 13, 1998 now U.S. Pat. No. 7,085,393, which claimed the benefit of the filing date of U.S. provisional application No. 60/065,855, filed on Nov. 14, 1997, the teachings of both of which are incorporated herein by reference.

BACKGROUND OF THE INVENTION

1. Field of the Invention

This invention relates generally to three-dimensional (3D) sound. More particularly, it relates to an improved regularizing model for head-related transfer functions (HRTFs) for use with 3D digital sound applications.

2. Description of the Related Art

Many high-end consumer devices provide the option for three-dimensional (3D) sound, allowing a more realistic experience when listening to sound. In some applications, 3D sound allows a listener to perceive motion of an object from the sound played back on a 3D audio system.

Atal and Schroeder established cross-talk canceler technology as early as 1962, as described in U.S. Pat. No. 3,236,949, which is explicitly incorporated herein by reference. The Atal-Schroeder 3D sound cross-talk canceler was an analog implementation using specialized analog amplifiers and analog filters. To gain better sound positioning performance using two loudspeakers, Atal and Schroeder included empirically determined frequency dependent filters. Without doubt, these sophisticated analog devices are not applicable for use with today's digital audio technology.

Interaural time difference (ITD), i.e., the difference in time that it takes for a sound wave to reach both ears, is an important and dominant parameter used in 3D sound design. The interaural time difference is responsible for introducing binaural disparities in 3D audio or acoustical displays. In particular, when a sound object moves in a horizontal plane, a continuous interaural time delay occurs between the instant that the sound object impinges upon one of the ears and the instant that the same sound object impinges upon the other ear. This ITD is used to create aural images of sound moving in any desired direction with respect to the listener.

The ears of a listener can be "tricked" into believing sound is emanating from a phantom location with respect to the listener by appropriately delaying the sound wave with respect to at least one ear. This typically requires appropriate cancellation of the original sound wave with respect to the other ear, and appropriate cancellation of the synthesized sound wave to the first ear.

A second parameter in the creation of 3D sound is adaptation of the 3D sound to the particular environment using the external ear's free-field-to-eardrum transfer functions, or what are called head-related transfer functions (HRTFs). HRTFs relate to the modeling of the particular environment of the user, including the size and orientation of the listeners head and body, as they affect reception of the 3D sound. For instance, the size of a listener's head, their torso, what they wear, etc., forms a form of filtering which can change the effect of the 3D sound on the particular user. An appropriate HRTF adjusts for the particular environment to allow the best 3D sound imaging possible.

The HRTFs are different for each location of the source of the sound. Thus, the magnitude and phase spectra of measured HRTFs vary as a function of sound source location. Hence, it is commonly acknowledged that the HRTF introduces important cues in spatial hearing.

Advances in computer and digital signal processing technology have enabled researchers to synthesize directional stimuli using HRTFs. The HRTFs can be measured empirically at thousands of locations in a sphere surrounding the 3D sound environment, but this proves to require an excessive amount of processing. Moreover, the number of measurements can be very large if the entire auditory space is to be represented on a fine grid. Nevertheless, measured HRTFs represent discrete locations in a continuous auditory space.

One conventional solution to the adaptation of a discretely measured HRTF within a continuous auditory space is to "interpolate" the measured HRTFs by linearly weighting the neighboring impulse responses. This can provide a small step size for incremental changes in the HRTF from location to location. However, interpolation is conceptually incorrect because it does not account for environmental changes between measured points, and thus may not provide a suitable 3D sound rendering.

Other attempted solutions include using one HRTF for a large area of the three-dimensional space to reduce the frequency of discontinuities which may cause a clicking sound. However, again, such solutions compromise the overall quality of the 3D sound rendering.

Another solution wherein spatial characteristic functions are combined directly with Eigen functions to provide a set of HRTFs is shown in FIG. 3.

In particular, a set N of Eigen filters 422-426 are combined with corresponding sets of spatial characteristic function (SCF) samples 412-416 and summed in a summer 440 to provide an HRTF (or HRIR) filter 450 which acts on a sound source 460. The desired location of a sound image is controlled by varying the sound source elevation and/or azimuth in the sets of SCF samples 412-416. Unfortunately, this technique is susceptible to discontinuities in the continuous auditory space as well.

There is thus a need for a more accurate HRTF model which provides a suitable HRTF for source locations in a continuous auditory space, without annoying discontinuities.

SUMMARY OF THE INVENTION

A head-related transfer function or head-related impulse response model for use with 3D sound applications comprises a plurality of Eigen filters. A plurality of spatial characteristic functions are adapted to be respectively combined with the plurality of Eigen filters. A plurality of regularizing models are adapted to regularize the plurality of spatial characteristic functions prior to the respective combination with the plurality of Eigen filters.

A method of determining spatial characteristic sets for use in a head-related transfer function model or a head-related impulse response model comprises constructing a covariance data matrix of a plurality of measured head-related transfer functions or a plurality of measured head-related impulse responses. An Eigen decomposition of the covariance data matrix is performed to provide a plurality of Eigen vectors. At least one principal Eigen vector is determined from the plurality of Eigen vectors. The measured head-related transfer functions or head-related impulse responses are projected to the at least one principal Eigen vector to create the spatial characteristic sets.

In one embodiment, the present invention is a method for generating a 3D sound signal. The method comprises (a) providing a regularized head-related transfer function (HRTF) filter and (b) applying an input sound signal to the regularized HRTF filter to generate the 3D sound signal. The regularized HRTF filter is generated by (1) generating a plurality of sets of spatial characteristic function (SCF) samples, (2) applying a corresponding regularizing model to each of one or more of the sets of SCF samples using a corresponding smoothness factor that trades off between smoothness and localization for the corresponding set of SCF samples, (3) combining each set of SCF samples with a corresponding Eigen filter, and (4) summing the results of the combining to generate the regularized HRTF filter.

In another embodiment, the present invention is a method for generating a 3D sound signal. The method comprises (a) providing a regularized head-related impulse response (HRIR) filter and (b) applying an input sound signal to the regularized HRIR filter to generate the 3D sound signal. The regularized HRIR filter is generated by (1) generating a plurality of sets of spatial characteristic function (SCF) samples, (2) applying a corresponding regularizing model to each of one or more of the sets of SCF samples using a corresponding smoothness factor that trades off between smoothness and localization for the corresponding set of SCF samples, (3) combining each set of SCF samples with a corresponding Eigen filter, and (4) summing the results of the combining to generate the regularized HRIR filter.

BRIEF DESCRIPTION OF THE DRAWINGS

Other aspects, features, and advantages of the present invention will become more fully apparent from the following detailed description, the appended claims, and the accompanying drawings in which like reference numerals identify similar or identical elements.

DETAILED DESCRIPTION

Conventionally measured HRTFs are obtained by presenting a stimulus through a loudspeaker positioned at many locations in a three-dimensional space, and at the same time collecting responses from a microphone embedded in a mannequin head or a real human subject. To simulate a moving sound, a continuous HRTF that varies with respect to the source location is needed. However, in practice, only a limited number of HRTFs can be collected in discrete locations in any given 3D space.

Limitations in the use of measured HRTFs at discrete locations have led to the development of functional representations of the HRTFs, i.e., a mathematical model or equation which represents the HRTF as a function of frequency and direction. Simulation of 3D sound is then performed by using the model or equation to obtain the desired HRTF.

Moreover, when discretely measured HRTFs are used, annoying discontinuities can be perceived by the listener from a simulated moving sound source as a series of clicks as the sound object moves with respect to the listener. Further analyses indicates that the discontinuities may be the consequence of, e.g., instrumentation error, under-sampling of the three-dimensional space, a non-individualized head model, and/or a processing error. The present invention provides an improved HRTF modeling method and apparatus by regularizing the spatial attributes extracted from the measured HRTFs to obtain the perception of a smooth moving sound rendering without annoying discontinuities creating clicks in the 3D sound.

Figure 3:
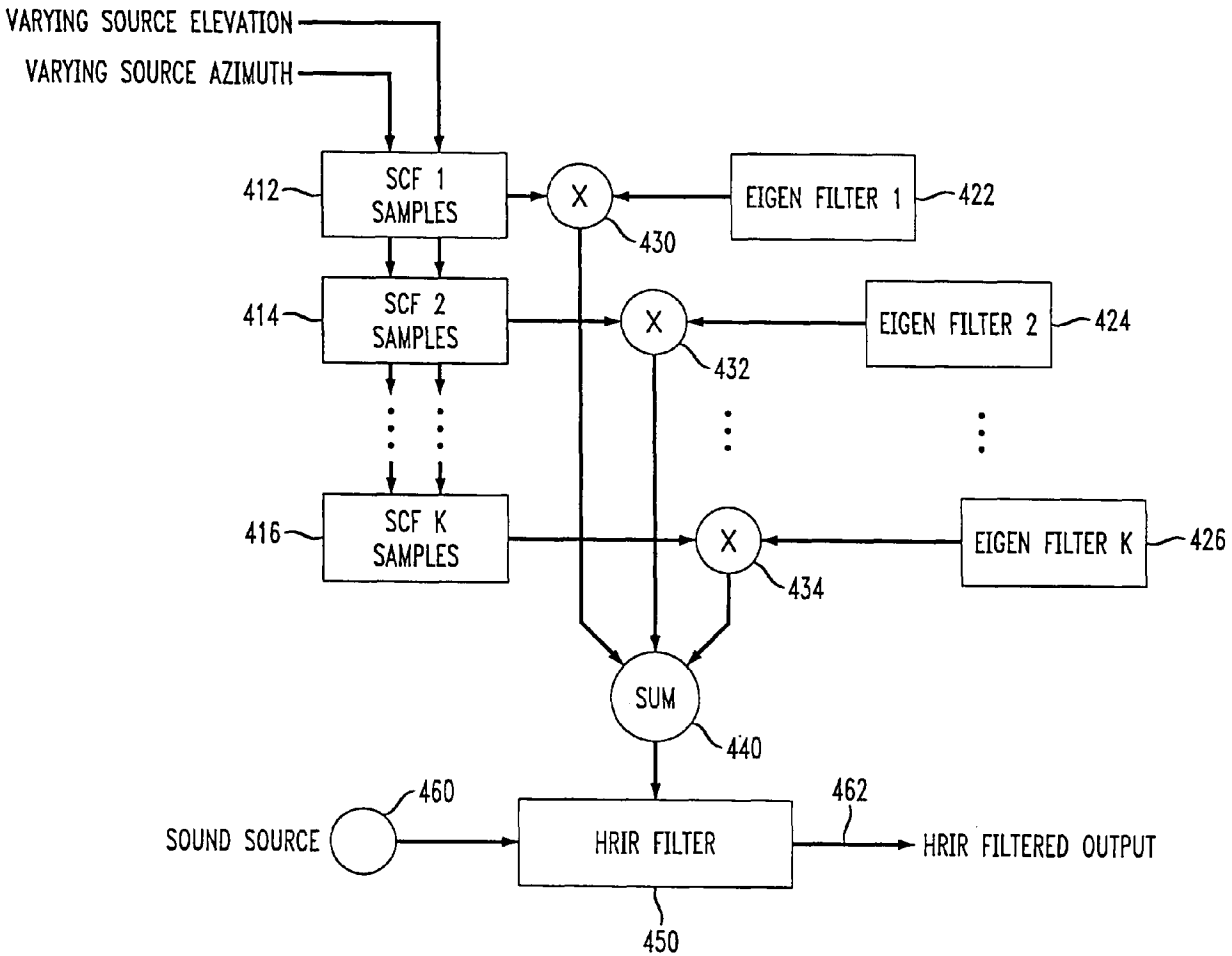
FIG. 3 PRIOR ART
FIG. 3 shows a conventional solution wherein spatial characteristic functions are combined directly with Eigen functions to provide a set of HRTFs.

HRTFs corresponding to specific azimuth and elevation can be synthesized by linearly combining a set of so-called Eigen-transfer functions (EFs) and a set of spatial characteristic functions (SCFs) for the relevant auditory space, as shown in FIG. 3 herein, and as described in "An Implementation of Virtual Acoustic Space For Neurophysiological Studies of Directional Hearing" by Richard A. Reale, Jiashu Chen et al. in *Virtual Auditory Space: Generation and Applications*, edited by Simon Carlile (1996); and "A Spatial Feature Extraction and Regularization Model for the Head-Related Transfer Function" by Jiashu Chen et al. in *J. Acoust. Soc. Am.* 97 (1) (January 1995), the entirety of both of which are explicitly incorporated herein by reference.

In accordance with the principles of the present invention, spatial attributes extracted from the HRTFs are regularized before combination with the Eigen transfer function filters to provide a plurality of HRTFs with varying degrees of smoothness and generalization.

Figure 1:
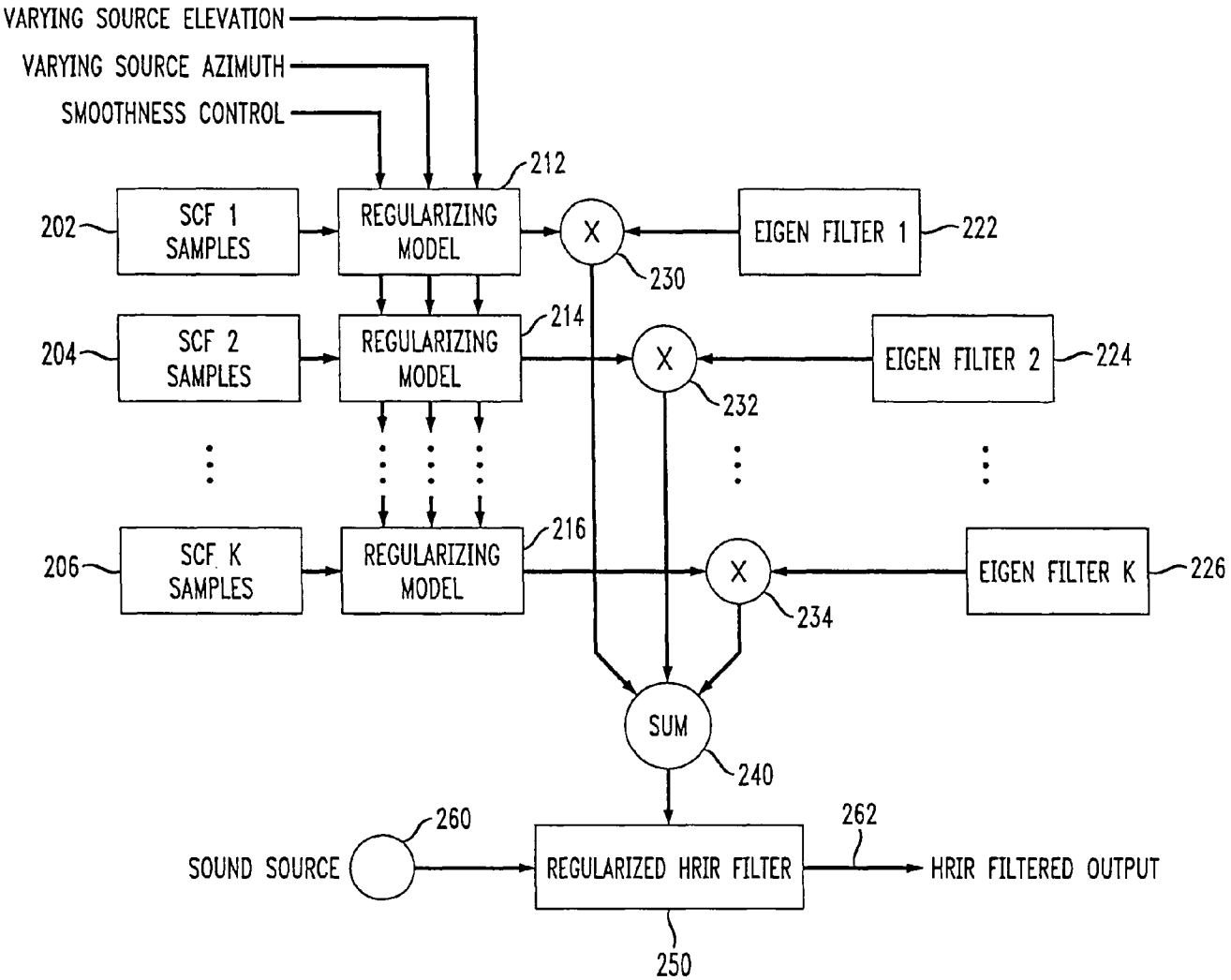
FIG. 1 shows an implementation of a plurality of Eigen filters to a plurality of regularizing models each based on a set of SCF samples, to provide an HRTF model having varying degrees of smoothness and generalization, in accordance with the principles of the present invention.

FIG. 1 shows an implementation of the regularization of a number N of SCF sample sets 202-206 in an otherwise conventional system as shown in FIG. 3.

In particular, a plurality N of Eigen filters 222-226 are associated with a corresponding plurality N of SCF samples 202-206. A plurality N of regularizing models 212-216 act on the plurality N of SCF samples 202-206 before the SCF samples 202-206 are linearly combined with their corresponding Eigen filters 222-226. Thus, in accordance with the principles of the present invention, SCF sample sets are regularized or smoothed before combination with their corresponding Eigen filters.

The particular level of smoothness desired can be controlled with a smoothness control to all regularizing models 212-216, to allow the user to adjust a tradeoff between smoothness and localization of the sound image. The regularizing models 212-216 in the disclosed embodiment performs a so-called 'generalized spline model' function on the SCF sample sets 202-206, such that smoothed continuous SCF sets are generated at combination points 230-234, respectively. The degree of smoothing, or regularization, can be controlled by a lambda factor, with trade-offs of the smoothness of the SCF samples with their acuity.

The results of the combined Eigen filters 222-226 and corresponding regularized SCF sample sets 202-206/212-216 are summed in a summer 240. The summed output from the summer 240 provides a single regularized HRTF (or HRIR) filter 250 through which the digital audio sound source 260 is passed, to provide an HRTF (or HRIR) filtered output 262.

The HRTF filtering in a 3D sound system in accordance with the principles of the present invention may be performed either before or after other 3D sound processes, e.g., before or after an interaural delay is inserted into an audio signal. In the disclosed embodiment, the HRTF modeling process is performed after insertion of the interaural delay.

The regularizing models 212-216 are controlled by a desired location of the sound source, e.g., by varying a desired source elevation and/or azimuth.

Figure 2:
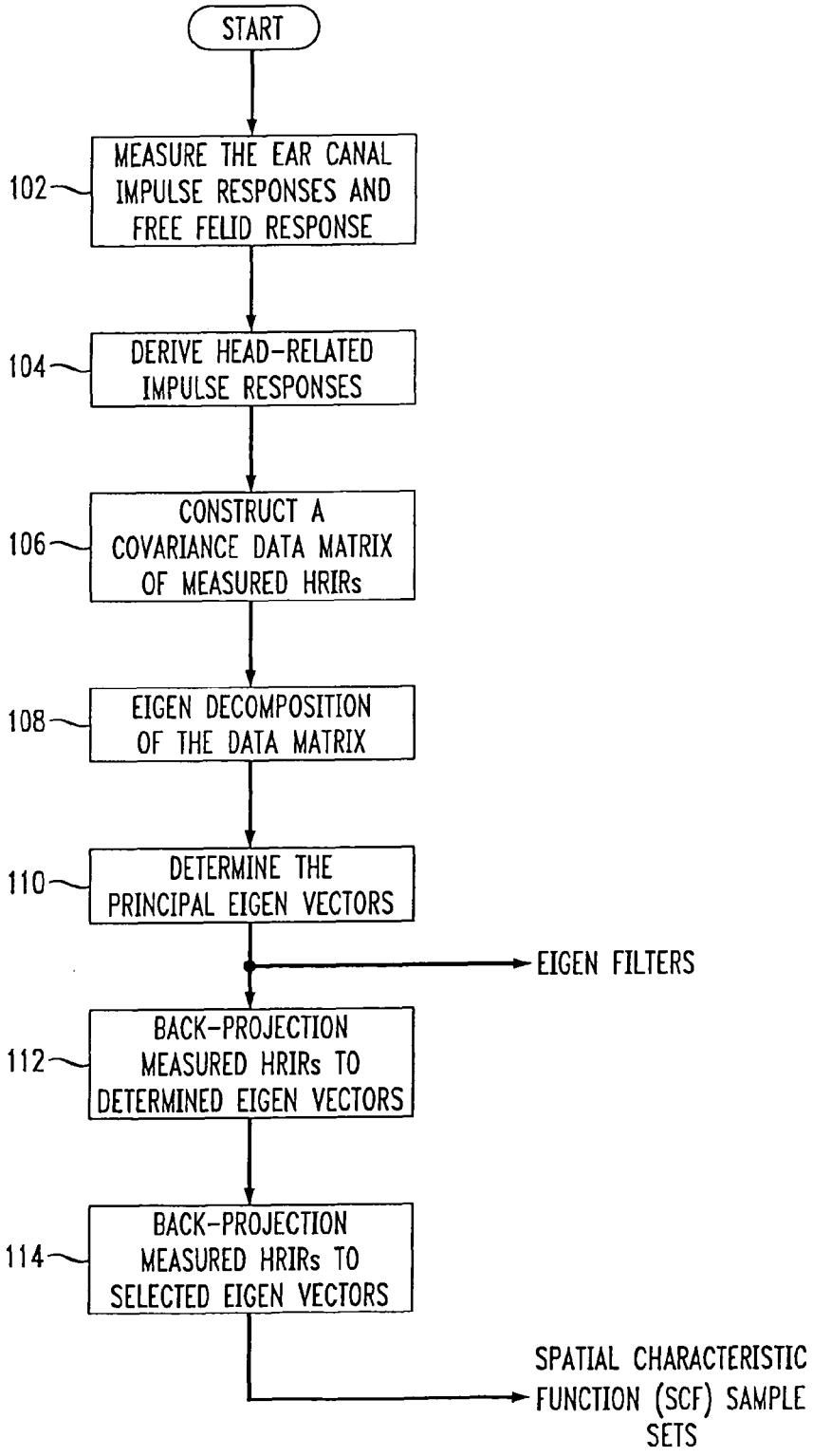
FIG. 2 shows a process for determining the principle Eigen vectors to provide Eigen filters used in the Eigen filters shown in FIG. 1, in accordance with the principles of the present invention.

FIG. 2 shows an exemplary process of providing the Eigen functions for the Eigen filters 222-226 and the SCF sample sets 202-206, e.g., as shown in FIG. 1, to provide an HRTF model having varying degrees of smoothness and generalization in accordance with the principles of the present invention.

In particular, in step 102, the ear canal impulse responses and free field response are measured from a microphone embedded in a mannequin or human subject. The responses are measured with respect to a broadband stimulus sound source that is positioned at a distance about 1 meter or farther away from the microphone, and preferably moved in 5 to 15 degree intervals both in azimuth and elevation in a sphere.

In step 104, the data measured in step 102 is used to derive the HRTFs using a discrete Fourier Transform (DFT) based method or other system identification method. Since the HRTFs are either in a frequency or time domain form, and since they vary with respect to their respective spatial location, HRTFs are generally considered as a multivariate function with frequency (or time) and spatial (azimuth and elevation) attributes.

In step 106, an HRTF data covariance matrix is constructed either in the frequency domain or in the time domain. For instance, in the disclosed embodiment, a covariance data matrix of measured head-related impulse responses (HRIR) are measured.

In step 108, an Eigen decomposition is performed on the data covariance matrix constructed in step 106, to order the Eigen vectors according to their corresponding Eigen values. These Eigen vectors are a function of frequency only and are abbreviated herein as "EFs". Thus, the HRTFs are expressed as weighted combinations of a set of complex valued Eigen transfer functions (EFs). The EFs are an orthogonal set of frequency-dependent functions, and the weights applied to each EF are functions only of spatial location and are thus termed spatial characteristic functions (SCFs).

In step 110, the principal Eigen vectors are determined. For instance, in the disclosed embodiment, an energy or power criteria may be used to select the N most significant Eigen vectors. These principal Eigen vectors form the basis for the Eigen filters 222-226 (FIG. 1).

In step 112, all the measured HRTFs are back-projected to the principal Eigen vectors selected in step 110 to obtain N sets of weights. These weight sets are viewed as discrete samples of N continuous functions. These functions are two dimensional with their arguments in azimuthal and elevation angles. They are termed spatial characteristic functions (SCFs). This process is called spatial feature extraction.

Each HRTF, either in its frequency or in its time domain form, can be re-synthesized by linearly combining the Eigen vectors and the SCFs. This linear combination is generally known as Karhunen-Loeve expansion.

Instead of directly using the derived SCFs as in conventional systems, e.g., as shown in FIG. 3, they are processed by a so-called "generalized spline model" in regularizing models 212-216 such that smoothed continuous SCF sets are generated at combinatorial points 230-234. This process is referred to as spatial feature regularization. The degree of smoothing, or regularization, can be controlled by a smoothness control with a lambda factor, providing a trade-off between the smoothness of the SCF samples 202-206 and their acuity.

In step 114, the measured HRIRs are back-projected to the principal Eigen vectors selected in step 110 to provide the spatial characteristic function (SCF) sample sets 202-206.

Thus, in accordance with the principles of the present invention, SCF samples are regularized or smoothed before combination with a corresponding set of Eigen filters 222-226, and recombined to form a new set of HRTFs.

In accordance with the principles of the present invention, an improved set of HRTFs are created which, when used to generate moving sound, do not introduce discontinuities causing the annoying effects of clicking sound. Thus, with empirically selected lambda values, localization and smoothness can be traded off against one another to eliminate discontinuities in the HRTFs.

While the invention has been described with reference to the exemplary embodiments thereof, those skilled in the art will be able to make various modifications to the described embodiments of the invention without departing from the true spirit and scope of the invention.

I claim:

1. A processor-implemented method for generating a 3D sound signal, the method comprising:

(a) providing a regularized head-related transfer function (HRTF) filter; and (b) applying an input sound signal to the regularized HRTF filter to generate the 3D sound signal, wherein the regularized HRTF filter is generated by:

(1) generating a plurality of sets of spatial characteristic function (SCF) samples;

(2) applying a corresponding regularizing model to each of two or more of the sets of SCF samples using a corresponding different smoothness factor that differently trades off between smoothness and localization for the corresponding set of SCF samples;

(3) combining each set of SCF samples with a corresponding Eigen filter; and (4) summing the results of the combining to generate the regularized HRTF filter.

2. The method of claim 1, wherein step (a) comprises generating the regularized HRTF filter.

3. The method of claim 2, wherein at least one smoothness factor is adaptively controlled to change the trade-off between smoothness and localization for the corresponding set of SCF samples.

4. The method of claim 1, wherein the corresponding regularizing model is applied to each corresponding set of SCF samples.

5. The method of claim 4, wherein the corresponding regularizing model is applied to each corresponding set of SCF samples using the corresponding different smoothness factor.

6. The method of claim 1, wherein each regularizing model performs a generalized spline model function on the corresponding set of SCF samples.

7. The method of claim 1, wherein the corresponding regularizing model is applied to each of the two or more of the sets of SCF samples using the corresponding different smoothness factor and a corresponding desired source direction.

8. The method of claim 7, wherein each desired source direction is indicated by at least one of a desired source elevation angle and a desired source azimuth angle.

9. The method of claim 1, wherein:

the corresponding regularizing model is applied to each corresponding set of SCF samples using the corresponding different smoothness factor;

each regularizing model performs a generalized spline model function on the corresponding set of SCF samples; and the corresponding regularizing model is applied to each of the two or more of the sets of SCF samples using the corresponding different smoothness factor and a corresponding desired source direction indicated by at least one of a desired source elevation angle and a desired source azimuth angle.

10. The method of claim 9, wherein:

step (a) comprises generating the regularized HRTF filter; and at least one smoothness factor is adaptively controlled to change the trade-off between smoothness and localization for the corresponding set of SCF samples.

11. A processor-implemented method for generating a 3D sound signal, the method comprising:

(a) providing a regularized head-related impulse response (HRIR) filter; and (b) applying an input sound signal to the regularized HRIR filter to generate the 3D sound signal, wherein the regularized HRIR filter is generated by:

(1) generating a plurality of sets of spatial characteristic function (SCF) samples;

(2) applying a corresponding regularizing model to each of two or more of the sets of SCF samples using a corresponding different smoothness factor that differently trades off between smoothness and localization for the corresponding set of SCF samples;

(3) combining each set of SCF samples with a corresponding Eigen filter; and (4) summing the results of the combining to generate the regularized HRIR filter.

12. The method of claim 11, wherein step (a) comprises generating the regularized HRIR filter.

13. The method of claim 12, wherein at least one smoothness factor is adaptively controlled to change the trade-off between smoothness and localization for the corresponding set of SCF samples.

14. The method of claim 11, wherein the corresponding regularizing model is applied to each corresponding set of SCF samples.

15. The method of claim 14, wherein the corresponding regularizing model is applied to each corresponding set of SCF samples using the corresponding different smoothness factor.

16. The method of claim 11, wherein each regularizing model performs a generalized spline model function on the corresponding set of SCF samples.

17. The method of claim 11, wherein the corresponding regularizing model is applied to each of the two or more of the sets of SCF samples using the corresponding different smoothness factor and a corresponding desired source direction.

18. The method of claim 17, wherein each desired source direction is indicated by at least one of a desired source elevation angle and a desired source azimuth angle.

19. The method of claim 11, wherein:

the corresponding regularizing model is applied to each corresponding set of SCF samples using the corresponding different smoothness factor;

each regularizing model performs a generalized spline model function on the corresponding set of SCF samples; and the corresponding regularizing model is applied to each of the two or more of the sets of SCF samples using the corresponding different smoothness factor and a corresponding desired source direction indicated by at least one of a desired source elevation angle and a desired source azimuth angle.

20. The method of claim 19, wherein:

step (a) comprises generating the regularized HRIR filter; and at least one smoothness factor is adaptively controlled to change the trade-off between smoothness and localization for the corresponding set of SCF samples.

* * * * *